United States Patent [19]

Gondo et al.

[11] 3,979,231

[45] Sept. 7, 1976

[54] METHOD FOR PRODUCING LARGE DIAMETER STEEL PIPES

[75] Inventors: Hisashi Gondo; Masatoki Nakayama; Hajime Nakasugi, all of Kisarazu; Masanobu Yamaguchi, Kimitsu, all of Japan

[73] Assignee: Nippon Steel Corporation, Tokyo, Japan

[22] Filed: Feb. 3, 1975

[21] Appl. No.: 546,783

[30] Foreign Application Priority Data

Feb. 4, 1974 Japan ..... 49-14292

[52] U.S. Cl. ..... 148/12 R; 148/12.4; 148/150; 148/153

[51] Int. Cl.[2] ..... C21D 9/08; C21D 9/14

[58] Field of Search ..... 148/150, 12 R, 12.4, 148/153

[56] References Cited

UNITED STATES PATENTS

| | | | |
|---|---|---|---|
| 3,140,964 | 7/1964 | Middlemiss | 148/153 |
| 3,407,099 | 10/1968 | Schell | 148/153 |
| 3,507,712 | 4/1970 | Scott | 148/153 |
| 3,755,010 | 8/1973 | Moliterno | 148/150 |
| 3,804,390 | 4/1974 | Jennings et al. | 148/153 |

*Primary Examiner*—W. Stallard

*Attorney, Agent, or Firm*—Wenderoth, Lind & Ponack

[57] ABSTRACT

A method for producing a large diameter steel pipe having excellent shape, toughness and tensile strength by subjecting the pipe to descaling and to heat treatment which involves heaing the steel pipe locally successively from one end to the other end of the steel pipe in the axial direction and forcedly cooling the pipe, and then expanding the steel pipe after the heat treatment.

9 Claims, 3 Drawing Figures

METHOD FOR PRODUCING LARGE DIAMETER STEEL PIPES

BACKGROUND OF THE INVENTION

The present invention relates to a method for producing large diameter steel pipes having excellent shape, toughness and tensile strength.

In recent years, along with increased demand for petroleum and natural gas, increased remoteness of their sources, and location of their sources in polar and colder areas, pipe lines for transporting these materials have been designed for low-cost and mass-transportation so that general tendencies have been toward enlargement of pipe diameter and high-pressure qualities and thus increased diameter and wall thickness of the pipes and increased tensile strength and toughness of the pipes have been demanded and with less residual internal stress, and excellent pipe shape as regards pipe straightness and roundness have been demanded.

It is now impossible to produce large diameter steel pipes having excellent shape, toughness and tensile strength to meet the above demands by conventional producing processes such as the UO process, the cage forming process, the spiral forming process, etc., and various production methods have been invented but none of them has ever been successful. Some of them will be explained hereinunder.

Japanese laid-open patent specification Sho 48-36014 (filing date: Sept. 8, 1972, laid-open date: May 28, 1973 and hereinafter called Invention A) discloses a method for treating a steel pipe of large diameter which comprises arranging an induction heating coil around the pipe, moving the pipe and the coil mutually to heat the pipe locally with a low frequency alternating current at a temperature not lower than the transformation point, cooling the pipe by means of a spray rapid cooling device surrounding the pipe, and tempering the pipe by means of an induction heating coil arranged around the pipe.

Also a Japanese Patent Publication (Filing date: Feb. 1, 1964; publication date: Mar. 22, 1967, hereinafter called as Invention B) discloses a method which comprises expanding a steel pipe produced by forming and welding, heating the pipe locally at a temperature between 650° and 1000°C by means of a coil and a low frequency induction current, and forcedly cooling as well as tempering the heated portions of the pipe.

However, it is impossible to obtain an excellent large diameter steel pipe which is the object of the present invention by the prior inventions A and B. This is because when heat treatment is carried out according to the prior inventions A and B, the following problems take place as compared with the pipe before the treatment.

1. The roundness of the pipe is remarkably inferior.
2. The straightness of the pipe is remarkably inferior.
3. Remarkably large residual stress exists.
4. The circumferential tolerance is remarkably bad.

1. Explanations will be given relating to problem (1). When a steel pipe is cooled uniformly under a restraining condition, the roundness of the pipe does not vary so far as no deformation due to local heating is caused. However, the length of steel pipes produced by an ordinary method is about 20 meters at the longest, and then the steel pipes are subjected to heat treatment one by one. In this case, the ends of the pipe are subjected to small restricting condition as compared with the other portions of the pipe, and are greatly deformed by external stress and internal stress. Therefore, when a steel pipe is expanded enough to fully satisfy the standard of API (Americal Petroleum Institute) as shown in Table I and then subjected to heat treatment according to the prior invention B. The size and shape of the pipe is severely deteriorated. In addition, the steel pipe with rolling scale and heating scale with thereon is treated no special cooling means in the invention B, so that remarkably irregular cooling effects are caused and thus the steel pipe made according to the invention B does not meet the desired standards very well.

2. Regarding the straightness problem (2), it is of course desirable to prevent the deformation due to gravity by localizing the heating and the cooling as much as possible, as described in the prior invention B. However, according to the results of tests conducted by the present inventors, the deformation due to gravity matters only when the length of the pipe heated is 5 times or more the pipe diameter (D), and it does not matter so much so far as the ordinary magnetic induction heating method is applied. It is rather whether or not the starting temperature of cooling, the volume of coolant and the finishing temperature of cooling are uniform across the cross section perpendicular to the axis of the pipe that determines the straightness of the pipe, and this has almost no relation with the straightness of the pipe before the treatment. In other words, it is necessary that the above three factors be maintained as uniformly as possible within the same cross section. The prior inventions A and B give no consideration to these conditions.

The residual stress which is caused during the quenching and tempering treatments and remains afterward should be as small as possible because a practical problem will occur in the respect of the following three points, if large residual stress exists within the finished steel pipe.

1. When the pipe is cut to a given length, the cut portion will have bad shape due to expansion or contraction.
2. The bending characteristics are reduced.
3. The fracture resistance is reduced.

When the steel pipe is forcedly cooled in the quenching or tempering treatment, large residual stress occurrs if only the outer surface is cooled as shown in Table 3. This residual stress is also one factor causing deterioration of the roundness and the straightness.

With regard to point (3) above, when the steel is quenched according to the method A, etc., the diameter of the outer circumference of the steel pipe is increased due to the transformation characteristics of the steel material and the wall thickness decreases. For this reason, even when the outer circumference is equalized along the entire length of the pipe by an expansion treatment prior to the quenching, the outer circumference change is not uniform due to the difference in the transformation characteristics caused by differences in the quenching conditions and the degrees of restraint at different points along the length of the. Particularly in case of quenching treatments of large diameter and thin walled steel pipes having low hardenability, the above tendencies are remarkable. Then after the quenching, the steel pipe is subjected to tempering for the purpose of adjusting the strength level and improving the toughness. In this case, the pipe diameter which has been enlarged by the expansion decreases depending on the tempering temperature. As explained above, the expansion treatment is necessary as in the present invention because the diameter change is not constant but varies depending on the treating condition even when the quenched and tempered steel pipe has been expanded to make the outer circumference uniform prior to the treatments.

The above explanations are true in connection with the center portion of the steel pipe which is subjected to a uniform restraint during the treatment, but, as is very obvious to the person skilled in the art, in the case of pipe portions such as the end portions which have are less restrained as compared with the center portion, the pipe diameter increases remarkably and the end of the pipe is formed into a trumpet-like shape. This can be prevented to some degree by controlling the restraint applied to the end portions and the cooling conditions, but in this case the qualities of the material in these portions become substantially different from those of the other portions due to the change of the cooling conditions at these portions, and thus no industrial advantage is obtained.

Therefore, one of the objects of the present invention is to overcome the above defects and to provide a method for producing a large diameter steel pipe having excellent shape as well as excellent toughness and tensile strength.

The features of the present invention lie in a method for producing a large diameter steel pipe having excellent shape, toughness and tensile strength which comprises subjecting the pipe to descaling and to heat treatment which comprises heating the steel pipe locally successively from one end to the other end of the steel pipe in the axial direction and forcedly the pipe, and expanding the steel pipe after the heat treatment.

Each of the above mentioned steps of the present invention will be described hereinunder referring to the attached drawings, in which.

I. The large diameter steel pipe to which the present invention is directed may be produced by ordinary pipe-making methods such as the UO pipe-making method, the spiral pipe-making method, the bending roll forming method, etc. There is no specific limitation in respect of the material quality, and the following ranges of the size of the pipe are selected.

Wall thickness: 6 mm or thicker (preferably 6 to 25 mm)

Diameter: 450 mm or larger (preferably 450 to 2000 mm)

Length: 2 meter or longer (preferably 6 to 20 m)

The above dimensional ranges have been defined in view of the efficiency of the induction heating by rapid heating, as well as the restrictions in the production of the pipe material and the pipe.

II. Descaling:

For practising the present invention, the steel pipe to be treated is descaled. One of the objects of the descaling is to improve cooling efficiency of the steel pipe at the time of the forced cooling following the local heating of the pipe.

If the scale is adhering to the pipe at the time of the heating and cooling, the cooling efficiency is remarkably lowered (see Table 4) so that no quenching is effected and only lowered strength and toughness can be obtained with the same composition. The second purpose of the descaling treatment is to assure uniform cooling and thereby to prevent deformation of the pipe (Table 4). In general, when a steel pipe is produced from steel plates by cold forming, the mill scale is removed locally by the forming strain. Therefore, there will be caused differences in the cooling efficiency between the portions to which mill scale is tightly adhered and the portions without the mill scale so that the cooling speed varies within the same cross section due to the non-uniform cooling effect and thus remarkable deformation is caused.

In order to prevent this deformation, it is essential to descale the pipe in the present invention. As for the descaling method, shot-blasing, sand-blasting, acid pickling and mechanical brushing may be used.

However, from the standpont of descaling efficiency and economy, and influence on the quality of the steel material, the shot-blasting method is most advantageous. Further, the descaling may be carried out or the steel plate before it is formed into the pipe.

Figure 1:
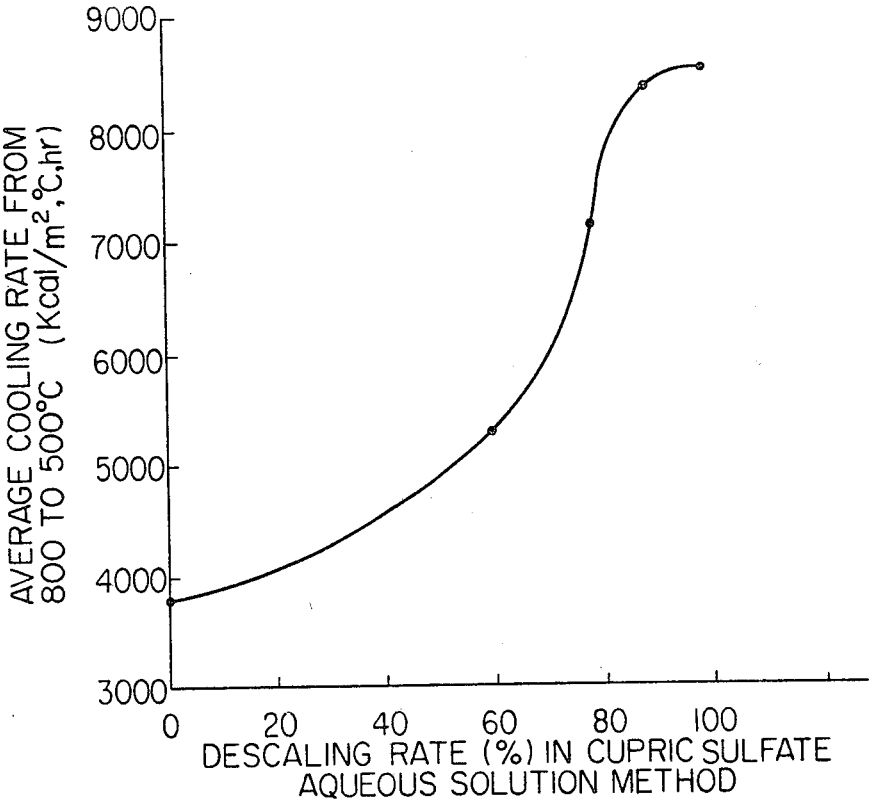
FIG. 1 is a graph of the relationship between the descaling rate and cooling efficiency.

The descaling should be effected to a degree of more than 90% as measured by the cupric sulfate aqueous solution method. The reasons for this requirement are shown in FIG. 1 showing the relation between the descaling rate and the cooling efficiency.

In this case, it is enough to descale only the outer surface of the steel pipe, if the forced cooling is effected from the outer surface.

The experimental conditions for determining the relation between the descaling rate and the cooling efficiency shown in FIG. 1 were as follows:

Grade of pipe: SM 50

Size of pipe: 10 thickness × 762 diameter × 12000 length (in mm)

Heating condition: at 910°C for 2.5 minutes

Cooling condition: starting temperature of cooling 880°C; finishing temperature of cooling 42°C Cooling water (pressure): $4M^3$/min. ($4kg/cm^2$)

Cooling method: using a nozzle of cylindrical slit type

Line speed: 100 cm/min.

III. Local rapid heating:

The large diameter, thin-wall steel pipe which has been descaled is subjected to local heat treatment prior to expansion working. The object of the local heat treatment is to prevent deformation by gravity of a straight pipe supported in a horizontal state, to improve toughness and to prevent formation of tightly adhering scale. In this connection, the term "short" means a local length in the axial direction of the steel pipe, and in the present invention it is limited to a length less than 5 times the outer diameter (D) of the steel pipe. Where rapid heating is necessary, it can be carried out by the combination of more than one magnetic induction coil. The rapid heating is utilized in order to avoid scale formation heating to a temperature higher than 600°C is necessary. Where heating only to a temperature below 600°C is needed no deformation and no scale is caused by the heating and thus rapid heating is not required so that any desired heating means may be used. For quenching, the steel pipe is heated to a temperature range of 850° (not lower than $Ar_3$) to 1000°C (lower than the coarsening temperature of austenite grains), and for tempering, the steel pipe is heated to a temperature range of 450° to 700°C (not higher than $Ar_1$) which is higher than the lowest temperature necessary for improving toughness. Regarding the heating rate, any heating rate may be used if the heating is within the temperature range not higher than 600°C, but a heating rate of 100°C/min. or faster is desirable in a temperature range of 600° to 1000°C. As for the local heating, a moving type of heating means is desirable, because continuous cooling in a moving manner can maintain the portions before and after the heated portion as a cold pipe at a temperature close to the ambient temperature and increase the degree of restraint to prevent deformation. For example, a large diameter, thin-wall straight steel pipe is advanced in a horizontal direction through a fixedly arranged magnetic induction heating coil by a shaft driving system of tabor-shaped table rolls, or the coil is moved along the length of the steel pipe which is fixed in position.

IV: Forced cooling:

The forced cooling following the local heating is conducted prior to the pipe expansion. The objects of the forced cooling are as follows:

1. Improvement of strength and toughness by quenching.

2. Increase of the degree of restraint of portions adjacent to the heated portion.

3. Uniform cooling for preventing deformation during the cooling (the cooling effect is different between the upper portion and the lower portion when the cooling is done in air.)

4. Correction of straightness of the steel pipe.

As for the means for the forced cooling, at least one cylindrical cooling ring which jets out coolant, such as water or a mixture of vapour and water is arranged in a straight line coaxially along the length of the large diameter steel pipe. For attaining the above object (4) the cooling ring is forcedly displaced from a position coaxial with the pipe to an eccentric position so as to control the angle of the water stream, for example, against the outer surface of the steel pipe in the circumferential direction of the steel pipe, whereby the straightness of the steel pipe can be corrected.

For example, when bending of the pipe caused during the pipe production is to be straightened, the straightening can be carried out by causing the cylindrical ring to be eccentric to the pipe so that the convex side of the pipe due to the bending is cooled more rapidly than the opposite concave side.

As for the cooling conditions, the cooling is carried out with an average thermal conductivity rate more than 2000 k cal/°C,$m^2$, hr. and at an average cooling rate more than 10°C/sec. from 800°C to 500°C. When the cooling does not satisfy the above conditions, the cooling rate of the circumferential cross section of the pipe is not constant in case of using the cylindrical cooling ring, and a substantial difference in the cooling rate is caused between the upper surface and the lower surface so that the straightness and the roundness are substantially deteriorated.

The cylindrical cooling ring may be composed of several divisions, and by controlling the amount of water jetted from each of the nozzle divisions, similar results can be obtained as when the cooling nozzle is caused to assume as eccentric position as described above.

Figure 3:
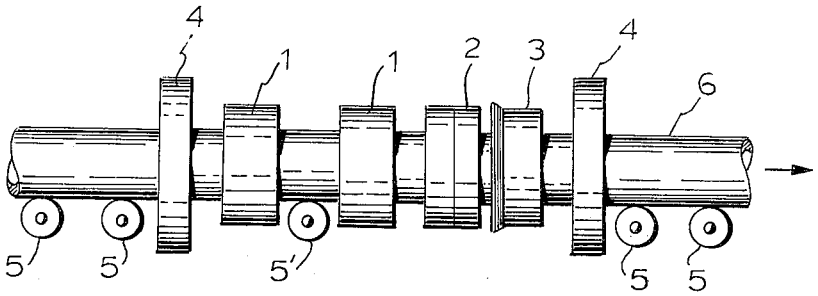
FIG. 3 is a schematic view of an apparatus for carrying out heat treatment according to the present invention.

FIG. 3 is a schematic view of an apparatus for the heat treatment according to the present invention. In the figure, 1 represents induction heating coils, arranged in groups of three coils. 2 is a cylindrical cooling ring having a nozzle for jetting cooling water all around the inner circumference. In this embodiment two cooling rings are provided so as to cool the steel pipe in two steps. 3 is a dewatering device for removing water adhering to the pipe 6. 4 represents pipe restricting devices such as pinch rolls. 5 represents table rolls for transferring the pipe 6. 5' is a non-magnetic table roll.

V. Pipe expansion:

The object of expanding the large diameter pipe after the pipe has been descaled and then subjected to the specific heat treatment is explained below.

1. The roundness of the two end portions (equivalent to about 1.5 times of the outer diameter of the pipe) of the pipe does not satisfy the standards shown in Table 1 even with the combination of the above mentioned improved production steps. In other words, the roundness is damaged by the discontinuity of the degree of restraint and the increase of volume by quenching, and therefore, the roundness should be corrected by the expansion of the pipe.

2. The residual stress due to the discontinuity at the ends of the large diameter pipe is removed.

3. The residual stress due to the cooling of only the outer surface is removed. (Metallurgically, the residual stess is caused by the difference in the quenched structure due to the cooling rate difference between the outer surface and the inside surface. Also even in the case of heating below $Ar_1$, a residual stress due to thermal strain is caused by the cooling rate difference between the outer surface and the inside surface.)

4. Correction of roundness.

Figure 2:
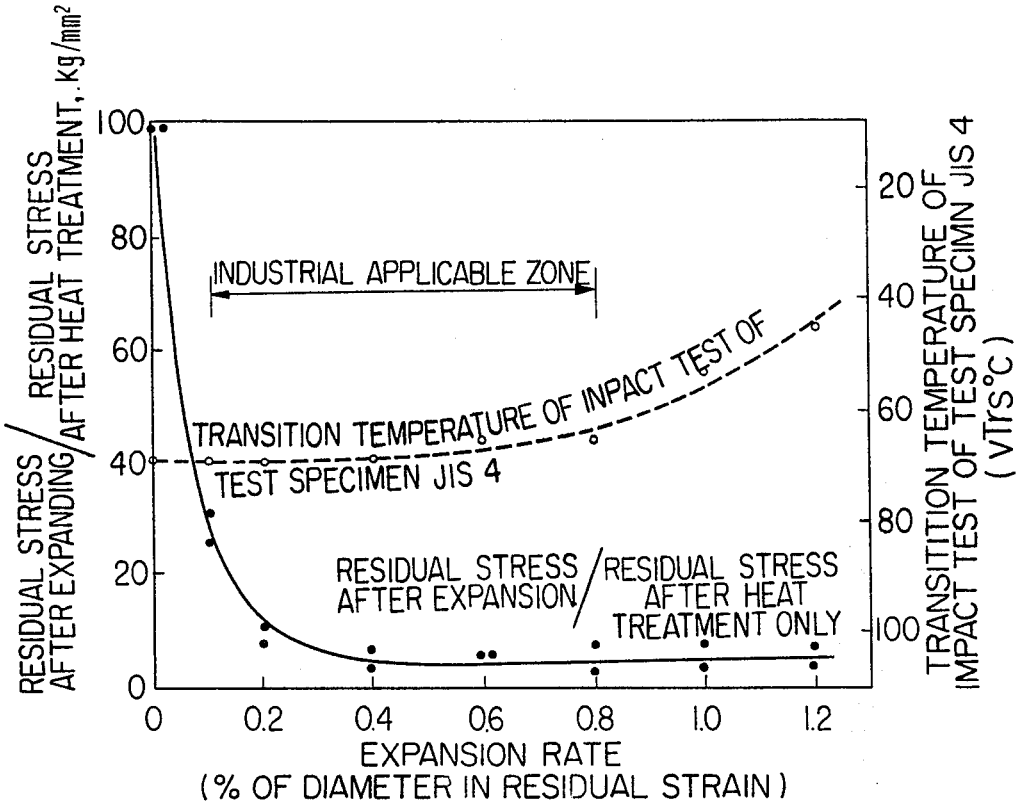
FIG. 2 is a graph of the variations of residual stress due to expansion after heat treatment according to the present invention.

As for the pipe expansion method, a mechanical or hydraulic method may be adopted, and the expansion is carried out in a range of 0.1 to 0.8% preferably 0.3 to 0.5% of the diameter in residual plasticity strain for the reasons which can be seen from FIG. 2.

FIG. 2 shows variations (in the circumferential direction of the pipe: measured by the strain-gage method) of the residual stress due to the expansion after the heat treatment which was done under the following conditions.

Steel pipe grade: SM 50

Steel pipe size: 15 mm × 762 mm × 12000 mm

Heating: 910°C for 2.5 minutes

Cooling: Starting temperature: 890°C;

Finishing temperature: 42°C;

Cooling water: $4M^3$/min.;

Cooling method: cylindrical slit type nozzle. outer surface cooling.

Line Speed: 0.6 cm/min.

Descaling: shot blast (98% descale)

Table 5 shows examples of the present invention which indicate excellent shape and size, as well as excellent residual stress values.

Table 1

API Standards for Steel Pipe Shape and Example of Prior Invention A (pipe size 10 mmt × 762 mmϕ × 12000 mml, steel grade: SM50)

| | Straightness | Roundness | | Outer Circumference Tolerance | |
|---|---|---|---|---|---|
| | | A distance of 4" from the ends of the pipe | Other than both ends | A distance of 4" from the ends of the pipe | Other than both ends |
| API | ≦2/1000 | $/D_o - D/ < 1\% D_o$ | $/D_o - D/ < 1\% D_o$ | $\pi(D_o - 1/32'') - \pi(D_o + 3/32'')$ | $-0.25\% \pi D_o$ $+0.75\% \pi D_o$ |
| Range of demensions for the example pipe by the above tolerance | | 754.4 – 769.6 mm | 754.4 – 769.6 mm | 2390.2 – 2400.2 mm | 2386.7 – 2410.6 mm |
| Before expansion | 2.8/1000 | 753 – 775 mm | 752 ± 10 mm | 2393 ± 6 mm | 2393 ± 4 mm |
| After expansion (1.25%) | 1.3/1000 | 762.5 – 764 mm | 762 ± 3 mm | 2396 ± 2 mm | 2396 ± 2mm |

$D_o$: Nominal outside diameter
D: Actual pipe outer diameter

Table 2

Size and Accuracy of Steel Pipe obtained by the Method of Prior Invention A

| | Production | Steel Composition | Pipe Size (mm) Wall thickness | Outer Diameter | Length | Descaling |
|---|---|---|---|---|---|---|
| A | UO Method | SM 50 | 10 | 762 | 12000 | No |
| B | " | " | 15 | " | " | " |
| C | " | " | 20 | " | " | " |

| | Heating Condition: Heating Temp. °C | Heating Method | Cooling Condition: Starting Temp. of Cooling °C | Finishing Temp. of Cooling °C | Expansion After Heat Treatment and its Ratio (%) |
|---|---|---|---|---|---|
| A | 910 | Induction Heating | 880 | 42 | No |
| B | " | " | 890 | " | " |
| C | " | " | 900 | " | " |

| | Roundness: Both Ends (mm) | Center (mm) | Straightness Measured by API Method (mm/mm) | Outer Circumference Tolerance: Both Ends (mm) | Center (mm) |
|---|---|---|---|---|---|
| A | 751~783 | 754~775 | 3.1/1000 | 2410~2418 | 2408~2412 |
| B | 756~783 | 759~775 | 2.4/1000 | " | " |
| C | 755~780 | 758~755 | 1.9/1000 | 2411~2420 | 2404~2410 |

Table 3

Residual Stress After Heating-Cooling on Outer Surface of Steel Pipe Produced by Ordinary Production Method

| | Production Method | Steel Composition | Pipe Size (mm) Wall Thickness | Outer Diameter | Length | Descaling | Heating Condition: Heating Temp. °C | Heating Method |
|---|---|---|---|---|---|---|---|---|
| A | UO Method | SM 50 | 10 | 762 | 12000 | No | 910 & 650 | Induction Heating |
| B | " | " | 15 | " | " | " | " | " |
| C | " | " | 20 | " | " | " | " | " |
| D | " | " | 10 | " | " | " | 620 | " |

| | Cooling Condition: Starting Temp. °C | Finishing Temp. of Cooling °C | Expansion After Heat Treatment and its Ratio (%) |
|---|---|---|---|
| A | 880 | 42 | — |
| B | 890 | " | " |
| C | 900 | " | " |
| D | 600 | " | " |

Measurements of Residual Stress (By Strain Gage Method) (+means tension; −means compression stress)

| Before Treatment (kg/mm²) Radial inside surface | Radial outside surface | After QT Treatment (kg/mm²) Radial inside surface | Radial outside surface |
|---|---|---|---|

Table 3-continued

| Residual Stress After Heating-Cooling on Outer Surface of Steel Pipe Produced by Ordinary Production Method | | | | |
|---|---|---|---|---|
| A | −4.8 | +0.8 | +13.8 | −45.2 |
| B | −7.1 | +1.3 | +14.2 | −49.5 |
| C | −9.7 | +1.6 | +15.3 | −50.3 |
| D | −5.2 | +1.1 | +12.9 | −44.8 |

Table 4

Scale Adhering on Pipe Surface and Cooling Efficiency (Average at 800°C – 500°C)

| Remark | Production Method | Steel Composition | Pipe Size (mm) Wall Thickness | Outer Diameter | Length | Descaling* |
|---|---|---|---|---|---|---|
| | UO Method | SM 50 | 10 | 762 | 12000 | No |
| E | " | " | " | " | " | Yes (99%) |

| | Heating Condition: Heating Temp. °C | Heating Method | Cooling Condition: Starting Temp. of Cooling, °C | Finishing Temp. of Cooling, °C | Cooling Efficiency kcal/m², °C,hr. |
|---|---|---|---|---|---|
| | 910 | Induction Heating | 880 | 42 | 3700 |
| E | " | " | " | " | 8500 |

*Shot-Blasting followed by cupric sulfate aqueous solution method.

Measurements of Deformation

| | Roundness (Center, mm) Before Treatment | After Treatment | Straightness (per 12M, mm) Before Treatment | After Treatment | Outer Circumference Tolerance (Center, mm) Before Treatment | After Treatment | Expansion Ratio after Heat Treatment for Satisfying API Standards (%) |
|---|---|---|---|---|---|---|---|
| | 761~763 | 754~775 | — | 18 | 2391 ± 2 | 2410 ± 8 | 1.5 |
| E | " | 765~773 | " | 14 | " | 2412 ± 3 | 0.3 |

Table 5

Examples by the present inventive method (Quenching and Tempering by) Outer Surface Cooling)

| Remark | Production Method | Steel Composition** | Pipe Size mm) Wall Thickness | Outer Diameter | Length | Descaling* | Heating Condition: Heating Temp. °C | Heating Method |
|---|---|---|---|---|---|---|---|---|
| 1 | UO Method | SM 50(JIS) | 10 | 762 | 12000 | Yes (more than 98%) | 910 / 650 | Induction Heating |
| 2 | " | " | 15 | " | " | " | " | " |
| 3 | " | " | 20 | " | " | " | " | " |
| 4 | SP Method | " | 10 | " | " | " | " | " |

| | Cooling Condition (Cooled for Correcting Roundness) Starting Temp. of Cooling °C | Finishing Temp. of Cooling °C | Expansion Ratio After Treatment |
|---|---|---|---|
| 1 | 880 / 620 | 42 | Yes 0.4 |
| 2 | 890 / 625 | " | " 0.8 |
| 3 | 900 / 630 | " | " 0.5 |
| 4 | 880 / 620 | " | " |

**Example of SM50 Composition (%)

| C | Si | Mn | P | S | Al |
|---|---|---|---|---|---|
| 0.14 | 0.27 | 1.37 | 0.018 | 0.010 | 0.025 |

* Shot-blasting followed by cupric sulfate aqueous solution method.

| Remark | Roundness Both Ends (mm) | Center (mm) | Measurement by as per API (mm/mm) | Outer Circumference Tolerance Both Ends (mm) | Center (mm) | Residual Stress in Radial Direction (Center Portion in the Lengthwise Direction kg/mm²) Inside Surface | Outside Surface |
|---|---|---|---|---|---|---|---|
| 1 | 762 765 | 763 – 765 | 1.4/1000 | 2395±4 | 2395±2 | −1.2 | +0.2 |
| 2 | 761 – 765 | 762 – 765 | 1.2/1000 | " | " | −0.8 | +0.1 |
| 3 | 762 – 766 | 761 – 764 | 0.8/1000 | 2395±6 | 2395±4 | −0.7 | +0.3 |
| 4 | 761 – 763 | 763 – | 1.1/1000 | 2395±4 | 2395±2 | −1.2 | +0.2 |

Table 5-continued

| Examples by the present inventive method (Quenching and Tempering by) Outer Surface Cooling) |
|---|
| 764 |

*By Strain Gage Method; + means tension, − means compression stress.

Table 6

| | Properties of Inventive Steel Pipe | | | | |
|---|---|---|---|---|---|
| | YS (kg/m²) | TS (kg/m²) | EL (%) | CV-60°C(kg-m) | 50% FATT |
| 1 | 49.5 | 59.6 | 39 | 16.5 | −80°C |

Production Condition of this Table (1) is same as (1) in Table 5.

What is claimed is:

1. A method for producing a large diameter steel pipe having excellent shape, toughness and tensile strength, comprising subjecting the pipe to descaling, heat treating the pipe by heating the steel pipe at least one time locally successively from one end to the other end of the steel pipe in the axial direction, and forcedly cooling the steel pipe after each heating step at an average thermal conductivity rate not lower than 2000 Kcal/°C m².hr. between 800°C and 500°C and an average cooling rate not lower than 10°C/sec. between 800°C and 500°C, and expanding the steel pipe after the heat treatment.

2. A method according to claim 1 in which the heating of the steel pipe locally successively comprises heating to a temperature between the $Ar_3$ transformation point and the coarsening temperature of the austenite grains.

3. A method according to claim 1 in which the heating of the steel pipe locally successively comprises heating to a temperature of from 850° to 1000°C.

4. A method according to claim 1 in which the pipe is expanded with an expansion ratio of 0.1 to 0.8% of the diameter in residual plastic strain.

5. A method according to claim 4 in which the pipe is expanded with an expansion ratio of 0.1 to 0.8% of the diameter in residual plastic strain.

6. A method according to claim 1 in which the steel pipe is tempered after the heating.

7. A method according to claim 6 in which the tempering of the heat-treated steel pipe is carried out at a temperature of from 450°C and 700°C.

8. A method according to claim 1 in which the local heating and the forced cooling are carried out a plurality of times

9. A method as claimed in claim 1 in which the descaling comprises descaling to a large degree of more than 90% as measured by the cupric sulfate aqueous solution method.

* * * * *